US007051919B1

(12) United States Patent
Walsh

(10) Patent No.: US 7,051,919 B1
(45) Date of Patent: May 30, 2006

(54) CONVERTIBLE PIZZA BOX

(76) Inventor: William R. Walsh, 1775 Orange Ave., #2, Costa Mesa, CA (US) 92627

( * ) Notice: Subject to any disclaimer, the term of this patent is extended or adjusted under 35 U.S.C. 154(b) by 0 days.

(21) Appl. No.: 10/646,269

(22) Filed: Aug. 22, 2003

(51) Int. Cl.
*B65D 5/00* (2006.01)

(52) U.S. Cl. ..... 229/103; 229/101.1; 229/120.011; 229/115

(58) Field of Classification Search ..... 229/103, 229/101.1, 120.011, 108, 115, 116
See application file for complete search history.

(56) References Cited

U.S. PATENT DOCUMENTS

| | | | | | |
|---|---|---|---|---|---|
| 1,933,643 | A | * | 11/1933 | Tanner | 229/115 |
| 2,361,923 | A | * | 11/1944 | Arneson | 206/299 |
| 2,444,987 | A | * | 7/1948 | Giessen | 229/115 |
| 2,894,673 | A | * | 7/1959 | Vuillemenot | 229/113 |
| 3,412,924 | A | * | 11/1968 | Krzyzanowski | 229/120.011 |
| 4,535,928 | A | * | 8/1985 | Capo | 229/103 |
| 5,071,062 | A | | 12/1991 | Bradley et al. | |
| 5,110,038 | A | | 5/1992 | Pantisano et al. | |
| 5,197,659 | A | | 3/1993 | Vassiliou | |
| 5,209,392 | A | * | 5/1993 | Anatro | 229/117.01 |
| 5,445,314 | A | | 8/1995 | Newsome | |
| 5,476,214 | A | | 12/1995 | Fisk, Jr. | |
| D390,110 | S | | 2/1998 | Mario | |
| 5,713,509 | A | | 2/1998 | Correll | |
| 5,833,130 | A | | 11/1998 | Correll | |
| 6,206,277 | B1 | | 3/2001 | Correll | |
| 6,375,066 | B1 | | 4/2002 | Ritter | |
| 6,386,440 | B1 | * | 5/2002 | Tulkoff | 229/120.32 |
| 6,440,050 | B1 | * | 8/2002 | Capparelli et al. | 493/59 |
| 2002/0079357 | A1 | | 6/2002 | Tulkoff | |
| 2003/0209592 | A1 | * | 11/2003 | Holden et al. | 229/103 |

* cited by examiner

*Primary Examiner*—Tri M. Mai
(74) *Attorney, Agent, or Firm*—Stout, Uxa, Buyan & Mullins, LLP; Linda A. Fox; Carlos A. Fisher

(57) ABSTRACT

A space saving box and a box useful for pizza and other relatively flat food products is provided. The box generally includes a one piece cardboard or paperboard blank having a first portion hingedly connected to a second portion. The blank is structured to include various score lines such that first and second portions are formable into a full sized pizza box. In addition, the blank is structured such that, when separated from the second portion, the first portion is formable into a reduced sized, space saving box having a tapering depth, for facilitating storage of leftover pizza slices, for example.

18 Claims, 4 Drawing Sheets

CONVERTIBLE PIZZA BOX

The present invention generally relates to food storage containers, and more specifically relates to blanks for making boxes useful for pizza and other relatively flat food products.

As the pizza industry has grown, there has developed a need for a pizza carton that can serve multiple functions and solve multiple problems.

Cartons for packaging flat food products, for example, pizza pies, are well known and are provided in a number of shapes and sizes. Typically, these packaging cartons are formed from a single blank, for example, a flat generally rectangular blank made of cardboard, which is scored so that it can be manually folded and formed to define a three dimensional carton. A pizza carton blank is typically cut and scored so as to be foldable to form a substantially square or orthogonal carton which is sized to accommodate an entire pizza pie, for example, a full size pizza having a diameter of up to about 16 inches or greater.

Pizza cartons of the type described above are most commonly used by home delivery pizza services and restaurants which offer carry-out services. Such businesses are enjoying ever increasing popularity and thus there has been an increased desire to provide boxes or cartons which better serve the needs of the home delivery or carry-out customer.

Consumers are showing an increasing desire and need for convenience. Convenience foods, such as hamburgers, are commonly eaten in an automobile, by both passengers and driver alike. Pizza slices, however, are by nature soft and floppy, and when purchased as a whole, as is typical, a pizza pie is usually divided amongst several people. For these reasons, a pizza pie is generally considered too messy for consumption during travel, unless, of course, significant preparation and planning is involved, for example, dinner plates are taken along on the trip. Consumers would welcome a pizza box that is designed to facilitate eating a pizza pie for example, by several people, without the need for such preparation and planning.

Furthermore, a pizza pie is often not consumed in its entirety in one sitting. Any leftover pizza slices can be stored for later consumption. Individual pizza slices are often kept in the original box or carton in which the complete pizza was provided, or alternatively, are wrapped in plastic or aluminum foil, and stored in a refrigerator. Consumers are well aware that these are not optimal storage means, however. As mentioned above, a typical pizza box is designed to hold a full sized pizza and therefor requires substantial storage space, often more storage space than is available in an average refrigerator. Such a large flat surface of the pizza box often becomes a surface upon which other food items are placed and stored, for example multiple jars of food, thereby resulting in collapse of the pizza box causing damage to the pizza slices contained therein. On the other hand, wrapping individual slices of leftover pizza, for example in aluminum foil or plastic wrap, is messy and inconvenient, as well as wasteful.

U.S. Pat. No. 5,071,062, the specification of which is incorporated herein in its entirety by this specific reference, discloses a pizza container having a removable upper lid and a lower portion that is foldable upon itself to result in a reduced size storage container. This particular container, however, only reduces the length or width of the full-sized box, and not the depth of the box. Like a full-sized pizza box, this reduced-sized box, if left in a refrigerator for any length of time, will become a surface upon which other food items are stored, thereby damaging the contents of the box.

Another problem with a conventional pizza box is the cumbersome size and shape thereof, which make the box quite inconvenient for disposal in an average kitchen trash container. In order to dispose of an empty conventional pizza box, a consumer must either shred the box or forcibly fold or crush the box into a more compact size, in order to fit the box within the kitchen trash container. Another option for the consumer is to dispose of the box directly in a larger trash container, usually remotely located in a garage or outside of the house.

There still exists a need for a food storage box, for example a pizza carton, that is easy to use, convenient for storage of leftover food, for example pizza slices, useful while traveling, and unlikely to become a surface upon which heavy items are stored.

SUMMARY OF THE INVENTION

New food storage containers have been discovered. In a broad aspect of the invention, containers, or boxes, are provided that are structured and sized for enabling convenient, space saving storage of food.

More particularly, a box in accordance with the present invention generally comprises a first portion having a perimeter defined by opposing longitudinal side edges, a front edge and a back edge, and a second portion having a perimeter defined by opposing longitudinal side edges, a front edge and a back edge, wherein the second portion is hingedly coupled to the first portion.

In addition, the box comprises a pair of side walls, each coupled, for example, hingedly coupled, to one of the opposing longitudinal side edges of the first portion, a front end wall coupled, for example, hingedly coupled, to the front edge of the first portion, and a back end wall coupled, for example, hingedly coupled, to the back edge of the first portion.

Preferably, the blank further comprises additional sidewalls, each coupled, for example hingedly coupled, to one of the opposing longitudinal side edges of the second portion, an additional front end wall coupled, for example hingedly coupled, to the front edge of the second portion, and an additional back wall coupled, for example hingedly coupled, to the back edge of the second portion.

In a preferred embodiment of the invention, the box is formed of a foldable, one piece blank. For example, the blank is foldable to form the box in accordance with the present invention, wherein the box is in the form of a flat pizza box, for example, having conventional pizza box dimensions. For example, the blank is foldable to form a box suitable for holding a whole pizza pie having a diameter of up to about 16 inches, or greater.

Additionally, the blank is further structured such that the first portion of the blank may define a cover of the full sized box, and the second portion may comprise a bottom, or base, of the full sized box, or vice-versa. Preferably, when the first portion is separated, for example, the first portion is manually torn or otherwise separated, from the second portion of the blank, the first portion is foldable to form a convenient, reduced sized, space saving box. In a particularly advantageous aspect of the invention, the space saving box has a tapering depth. For example, the space saving box may have a maximum depth preferably no greater than a depth of a conventional pizza box, for example about 1.5 inches, wherein the depth tapers to define a substantially triangular cross-section of the box.

For example, the blank may further include a transverse score line, for example a single transverse score line extending substantially between the opposing longitudinal side edges of the first portion. The blank is suitably structured so that the first portion thereof can be relatively easily creased or folded along the transverse score line.

Preferably, the transverse score line is at least slightly off-set from a center of the first portion. In other words, for example, the transverse score line does not define a centerline, (i.e., a theoretical line extending across a center of the first portion), but is offset therefrom and is preferably parallel to the first portion front edge. For example, the transverse score line may be offset from the centerline a distance of about 0.5 of an inch.

Preferably, each of the side walls of the first portion includes a first score line and a second score line, wherein the first score line is disposed at an angle to the second score line. For example, the first score line and the second score line adjoin to define and angle therebetween, for example, an angle of about 150° degrees.

In addition, at least one of the first score line and the second score line of the corresponding side wall may adjoin the transverse score line that extends across the first portion of the blank. Preferably, both of the first score line and the second score line adjoin the transverse score line. More preferably, both the first score line and the second score line intersect or adjoin the transverse score line at a point generally located on one of the opposing longitudinal side edges of the first portion.

In a related aspect of the invention, each of the side walls of the first portion of the blank includes a side wall first segment and a side wall second segment.

More particularly, at least one of, and preferably both of, the side wall first segment and the side wall second segment are triangular in shape in at least one plane (and are hereinafter sometimes referred to as "first triangular segment" and "second triangular segment" respectively) and may be defined in part by the first and second score lines respectively. Preferably, each of the first and second triangular segments include an edge coextensive along at least a portion of one of the opposing longitudinal side edges of the first portion. In addition, each of the first and second triangular segments include an angle of between about 10° and about 30° which will define, approximately, a tapering angle of the space saving box.

Each of the side walls of the first portion may further include a side wall third segment, preferably also having a triangular shape in at least one plane, the side wall third segment being disposed generally between the first triangular segment and the second triangular segment. The third triangular segment is sized to provide support and/or a barrier to prevent a food product contained in the full sized box from slipping therefrom. In addition, the side wall is preferably structured such that a segment thereof is removable therefrom. For example, the third segment may be removable from the side wall, for example by being manually torn away from the side wall along the first and second score lines. This structure facilitates the forming or reforming of the blank into the tapered space saving box.

Accordingly, in a particularly advantageous embodiment of the invention, the blank is structured such that after being formed into a full sized box, the blank can be reconfigured, generally by manually tearing and folding along one or more of the various score lines provided thereon, to form a reduced sized, space saving box, for example suitable for containing "leftover" pizza slices, the space saving box having a sleek, easy to carry, gently tapering configuration.

In another aspect of the invention a space saving box is provided, the box generally comprising a container having a tapering depth.

In yet another aspect of the invention, a product formable into a space saving box is provided, wherein the product comprises a substantially flat portion, a pair of side walls each coupled to one of the opposing longitudinal side edges of the portion, a front end wall and a back end wall coupled to the portion, and at least one transverse score line on the portion extending substantially between the opposing longitudinal side edges, wherein when the portion is folded along the at least one transverse score line, the portion defines a box having a tapering depth.

Each and every feature described herein, and each and every combination of two or more of such features, is included within the scope of the present invention provided that the features included in such a combination are not mutually inconsistent.

These and other aspects of the present invention are apparent in the following detailed description and claims, particularly when considered in conjunction with the accompanying drawings in which like parts bear like reference numerals.

DETAILED DESCRIPTION

For purposes of the following description, as used herein, "score line" encompasses any line provided on a paperboard or cardboard blank for allowing the same to be folded in a predetermined fashion. By "foldable box" it is meant a box which takes its shape by folding different segments of a blank piece of flat material, such as cardboard for example, around score lines. This action is also called "formation" of the box. "Unfolded box" generally refers to the blank, while "folded box" generally refers to the shaped article after folding the miscellaneous segments around certain score lines.

The score lines may include indentations, miscellaneous cuts, through-cut slits, perforations, and the like. They have a maximum possible degree of weakening the box at their location, so that an operator may perform the folding as fast and as easily as possible, with a minimum chance of folding the box in the wrong place. Thus, the box may be folded, unfolded, and re-folded at will many times around the score lines without any substantial loss of its final integrity as a folded or formed box. Thus, score line generally refers to a preformed fold line which is free from perforations, partially perforated, or fully perforated.

Providing perforations along a fold line facilitates folding certain portions of the blank, particularly where the blank is formed from corrugated cardboard. Where thinner cardboard is used, preformed fold lines which are free from perforations are generally sufficient to allow folding as desired. Perforations also facilitate removal, for example by manually tearing, of one or more portions of the blank.

For example, in accordance with the present invention, some of the score lines are lines of weakness along which the blank can be torn so that portions of the full size blank can be easily removed. Such lines of weakness are preferably perforated lines, particularly where the box is formed from corrugated cardboard. However, cuts in and/or through the material of the blank need not necessarily be provided and perforated score line as used herein is intended to refer to any score line defining a line of weakness along which the material of the blank can be torn.

Figure 1:
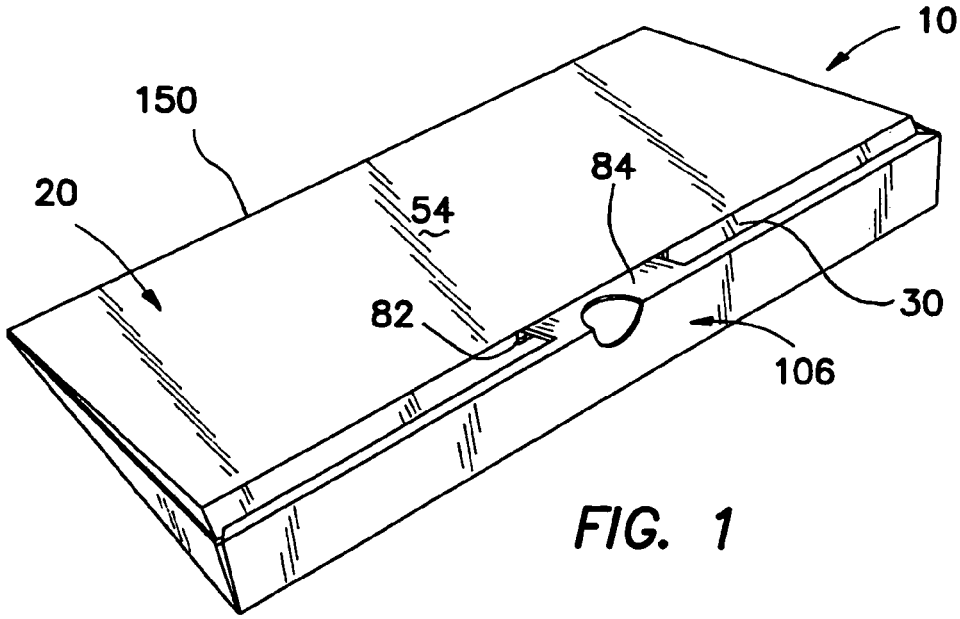
FIG. 1 shows a perspective view of a space-saving box, in accordance with the present invention.

Turning now to FIG. 1, a space saving box useful for pizza and other relatively flat food products is shown generally at 10. In the exemplary embodiment shown, the space saving box 10 has a relatively low profile for storing relatively flat products, for example, relatively flat food products, for example, but not limited to pizza pies, muffins, tarts, fruit pies, cookies, quiches, and the like. The space saving box 10 is preferably tapered in depth as shown.

Figure 2:
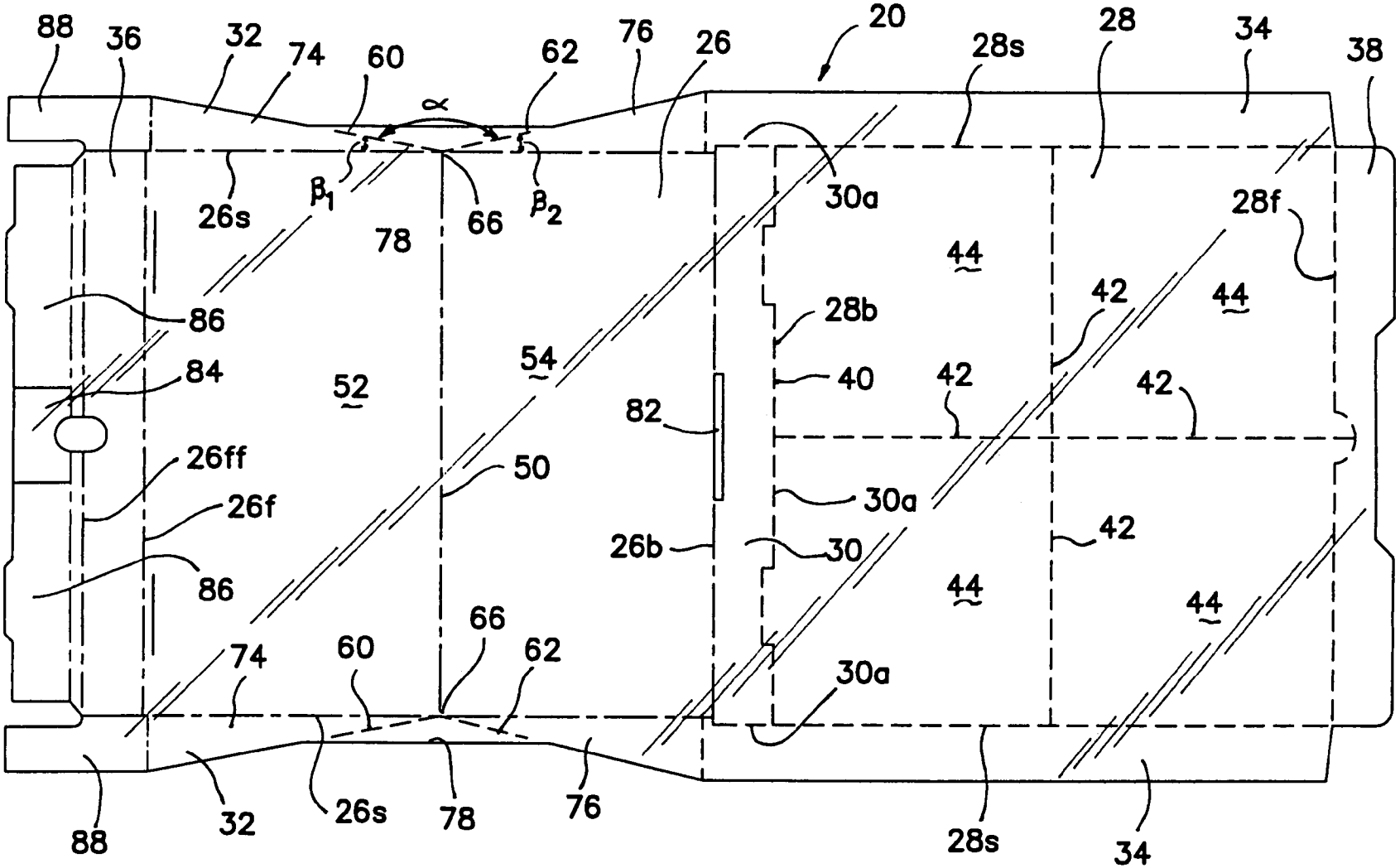
FIG. 2 shows a blank, in accordance with the present invention, useful for forming a full-sized pizza box, the blank including a first portion and a second portion, the first portion being suitable for forming the space saving box shown in FIG. 1.

Referring now to FIG. 2, there is depicted product, in accordance with one embodiment of the present invention. More particularly, the product comprises a blank 20 that is formable into a space saving box, for example the space saving box 10 shown in FIG. 1. Notably, in this particular embodiment of the invention, the blank 20 is suitable for forming both a relatively larger box (not shown in assembled form) for example, a box suitable for holding a whole pizza pie, as well as the space saving box 10 shown in FIG. 1. Thus, blank 20 is preferably structured to be configurable to form a full sized box that can accommodate a relatively large food product, for example a full sized pizza, and is further structured to be configurable to form a reduced size, space saving box (such as box 10 shown in FIG. 1) to accommodate a relatively smaller food product, for example, less than a full pizza, for example, one or more individual "leftover" pizza slices.

In the embodiment shown, blank 20 generally comprises a first portion 26 and a second portion 28. The first portion 26 has a perimeter defined by opposing longitudinal side edges 26*s*, a front edge 26*f* and a back edge 26*b*. Similarly, the second portion 28 has a perimeter defined by opposing longitudinal side edges 28*s*, a front edge 28*f*, and a back edge 28*b*.

The second portion 28 is preferably hingedly coupled to the first portion 26, for example by a common back panel 30 defined in part by the first portion back edge 26*b*, the second portion back edge 28*b*, and score lines 30*a*.

In addition, the blank 20 further comprises a pair of side walls 32 each preferably hingedly coupled to one of the opposing longitudinal side edges 26*s* of the first portion 26. Similarly, the blank 20 may further comprise additional side walls 34 each preferably hingedly coupled to one of the opposing longitudinal side edges 28*s* of the second portion 28.

In addition, the blank 20 may further comprise one or more front end walls, for example, first portion front end wall 36 and second portion front end wall 38, each preferably hingedly coupled to the front edge 26*f* of the first portion 26 and the front edge 28*f* the second portion 28, respectively.

The blank 20 also includes a plurality of primary folding lines disposed, for example as shown, along each of side edges 26*s* and 28*s*, front edges 26*f* and 28*f* and back edges 26*b* and 28*b*, which serve to form a full sized box (not shown) by folding along the folding lines the various portions of the blank 20 inwardly. More particularly, a full sized box is formable from blank 20 by folding the blank 20, generally inwardly (away from the page), for example, along the first portion back edge 26*b*, the second portion back edge 28*b*, score lines 30*a*, first portion front edge 26*f*, double score line 26*ff*, the second portion front edge 28*f*, first portion opposing longitudinal side edges 26*s*, and second portion opposing longitudinal side edges 28*s*.

It is noted and will be appreciated by those of skill in the art, that the layout of the primary folding lines may be consistent with a conventional full sized pizza box folding line layout. In the present state of the art, these folding lines may include indentations, through-cut slits, and the like in order to form a full sized pizza box having square or other than square dimensions, such as, for example, hexagonal, octagonal, and the like. The exemplary layout of primary folding lines shown in FIG. 2 should not be considered to limit the scope of the present invention, as other variations are possible that are considered to be within the scope of the present invention.

In accordance with the present invention, and unlike a conventional pizza box, back edge 28*b* is shown as a perforated score line that is suitable for manually separating, for example by tearing, first portion 26 from second portion 28. This is an important feature of the invention, as it allows a consumer to quickly and easily separate the first portion 26 from the second portion 28 in order to form the space saving box 10 from the first portion 26, as will be discussed in greater detail hereinafter.

Another feature of the present invention is crossed perforated score lines 42, which allow the second portion to be manually separated into a plurality of individual serving segments 44, suitable for serving slices of pizza to multiple people.

Figure 3:
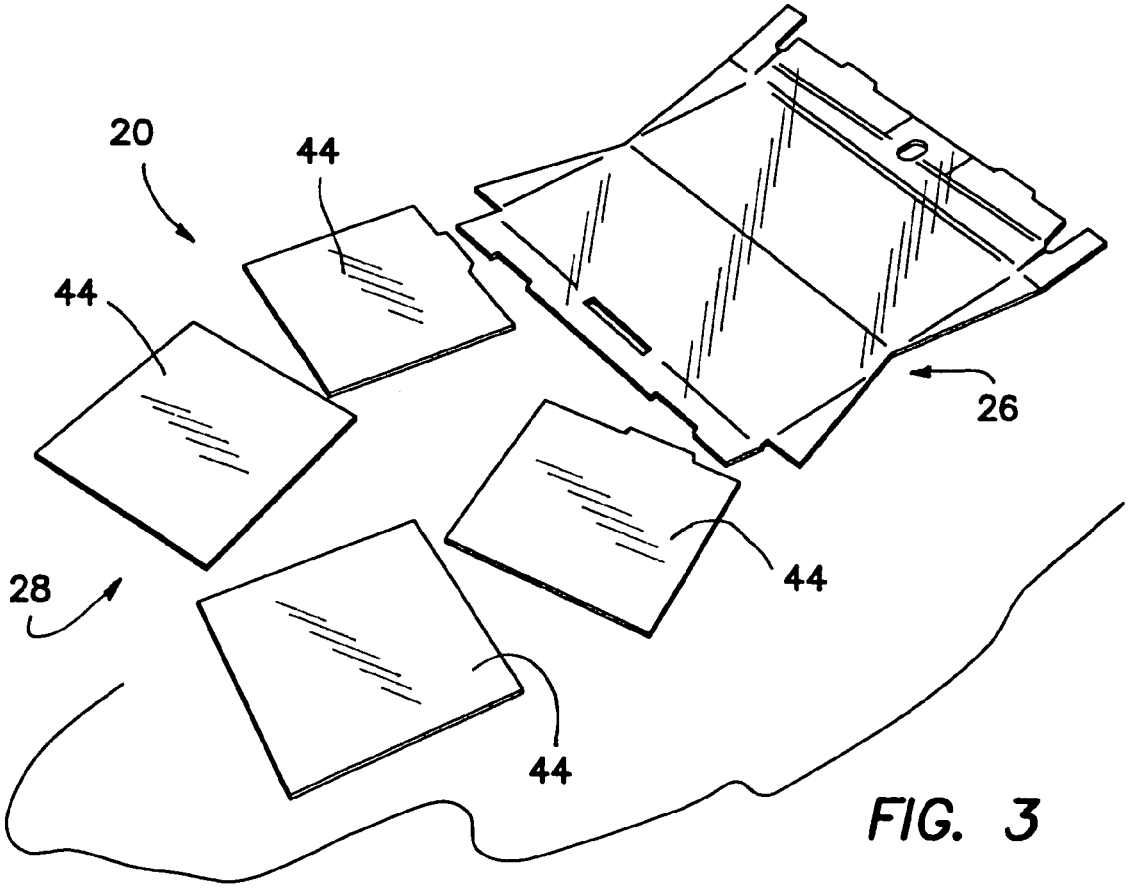
FIG. 3 shows a perspective view of the blank shown in FIG. 2 with the second portion separated from the first portion and the second portion being separated into individual plate-sized portions.

These and other aspects of the present invention may be more clearly understood with reference to FIG. 3. Preferably, when used for containing pizza, the blank 20 is configured such that first portion 26 defines a bottom of the full sized pizza box and second portion 28 defines a top of the full sized pizza box. Thus, when first portion 26 is separated from second portion 28, as shown, and segments 44 are separated from each other, as shown, any unserved pizza can be contained in space saving box made from folded first portion 26, and individual slices thereof can be contained on segments 44, which will be relatively free of grease, sauce and/or cheese.

Figure 4:
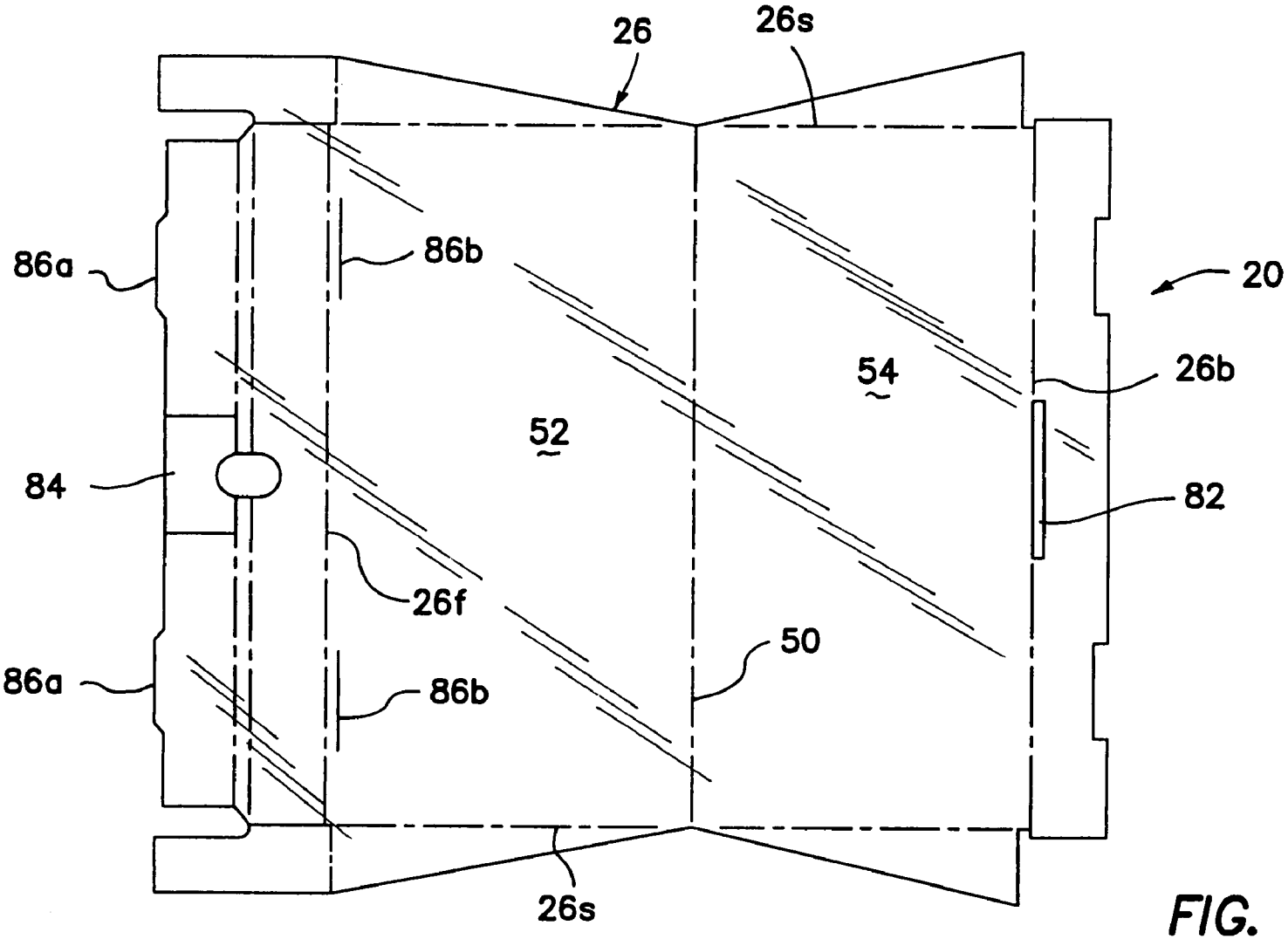
FIG. 4 shows generally, a plan view of the blank shown in FIG. 2 with the second portion removed therefrom.

Turning now to FIG. 4, blank 20, having second portion removed therefrom, is shown in a flat, unfolded configuration. In accordance with one especially advantageous embodiment of the invention, said blank 20 preferably further includes a transverse score line 50, for example on and across the first portion 26 as shown, and extending substantially between the opposing longitudinal side edges 26*s* of the first portion 26. Preferably, the transverse score line 50 comprises a single transverse score line that facilitates folding of the first portion 26, for example inwardly.

Preferably, the transverse score line 50 is offset, for example a minor distance, for example, a distance of between about 0.25 inches to about 0.5 inches, measured from a theoretical centerline of the first portion 26.

It is noted that transverse score line 50 may, in some embodiments of the invention, comprise more than one transverse score line, each being parallel to one another, for example a double transverse score line. In this case, it is preferred that a separation between adjacent parallel transverse score lines is less than a width a maximum depth of the space saving box, in order that the space saving box will have a tapering depth.

For purposes of illustration only, not to be considered as limiting the scope of the present invention, first portion 26 may have a width of about 16.5 inches (measured from front edge 26*f* to back edge 26*b* of first portion 26), and a length of about 16.5 inches measured between opposing longitudinal side edges 26*s*. Transverse score line 50 may be located substantially entirely across the first portion 26 at about 8.5 inches from and parallel to front edge 26*f*, thereby bisecting the first portion into unequal segments 52 and 54, wherein segment 52 is slightly wider than segment 54.

Turning back now to FIG. 2, preferably, each of the first portion side walls 32 includes a first score line 60 and a second score line 62, wherein the first score line 60 is disposed at an angle to the second score line 62. For example, the first score line 60 and the second score line 62 adjoin to define and angle a therebetween, for example, an angle of about 150° degrees. The first and second score lines 60 and 62 are preferably perforated in order to allow the blank 20 to be manually broken or torn therealong.

In addition, at least one of the first score line 60 and the second score line 62 adjoins the transverse score line 50. More preferably, both of the first score line 60 and the second score line 62 adjoin the transverse score line 50 and intersect the transverse score line 50 at points 66 generally located at corresponding longitudinal side edges 26*s* of the first portion 26.

Each of the side walls 32 may include a side wall first segment 74 and a side wall second segment 76 defined in part by the first score line 60 and the second score line 62, respectively. Preferably, at least one of, and more preferably, both of, the side wall first segment 74 and the side wall second segment 76 are triangular in shape as shown. Preferably, each of the side wall first segment 74 and the side wall second segment 76 have an edge coextensive with and disposed along at least a portion of the corresponding opposing longitudinal side edge 26*s* of the first portion 26. In addition, each of the triangular side wall first segment 74 and the triangular side wall second segment 76 includes an angle $\beta_1$ and $\beta_2$, respectively. Preferably, each of angle $\beta_1$ and $\beta_2$ are between about 10° and about 30°, which will define, generally, a tapering angle of the space saving box shown in FIG. 1.

Still referring to FIG. 2, each of the side walls 32 of the first portion 26 may further include a side wall third segment 78, preferably having a triangular shape, and being disposed generally between and abutting the side wall first segment 74 and the side wall second segment 76 as shown. Thus, it can be appreciated, from viewing FIG. 2, that the opposing side walls 32 of the first portion 26 may each be generally described as defining a modified elongated rectangle shape, having a narrow central portion and relatively wider end portions. The relatively narrow central portion, which includes third triangular segment 78, preferably has a width sufficient for preventing pizza or other food product from slipping out from the full sized box in the event the box is tilted while being carried, for example.

As shown in FIGS. 2 and 4, the blank 20 preferably further includes a slot 82 and a tab portion 84 sized to be inserted into the slot 82. Support portions 86, are provided as well and are separated from, or are separable from, tab portion 84. Longitudinal support tabs 88 are also provided.

Advantageously, in accordance with the present invention, the first portion 26 is structured to be formable into the space saving box 10 shown in FIG. 1. For example, score lines 60 and 62 are suitably made to allow manual removal of third triangular segment 78 from the first portion 26 to achieve the configuration of the first portion 26 shown in FIGS. 3 and 4. Prior to formation of the space saving box 10 (as will be described in greater detail hereinafter), third triangular segment 78 (not shown in FIGS. 3 and 4) is preferably removed from the blank 20 and discarded in a trash can, or more preferably, a recycling bin.

Figure 5:
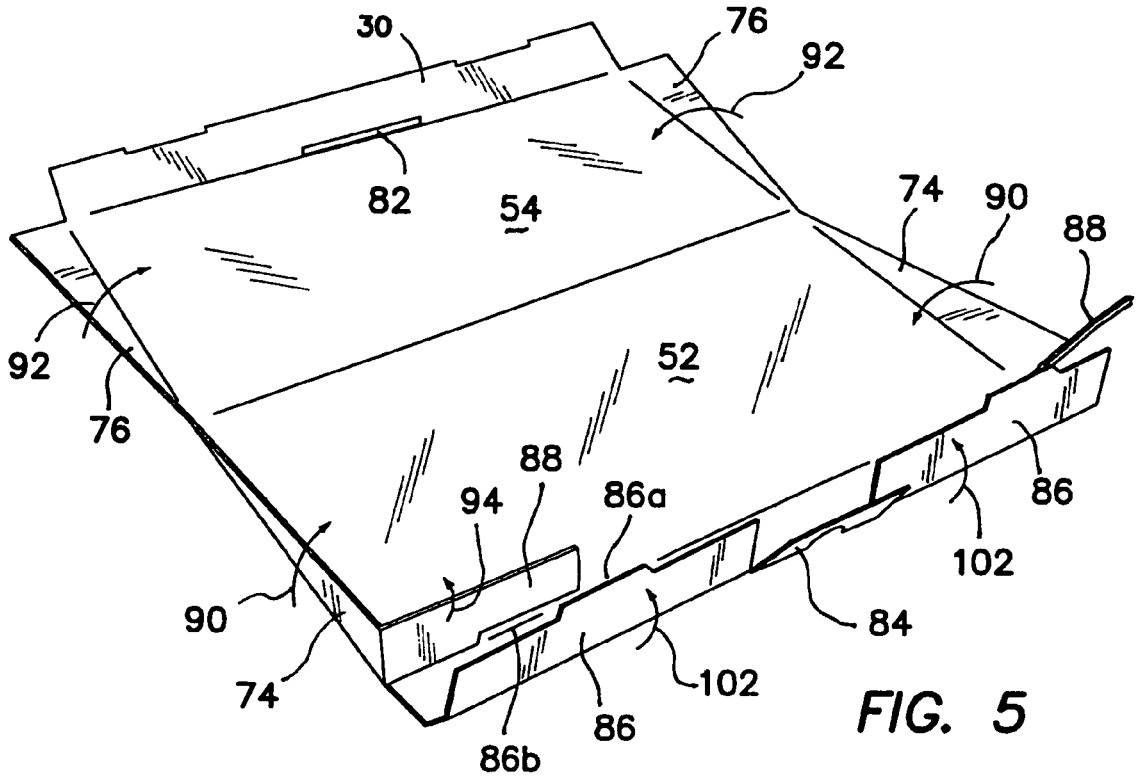
FIG. 5 shows a perspective view of the first portion of the blank shown in FIG. 2 as the first portion is being folded into the space saving box shown in FIG. 1.
Figure 6:
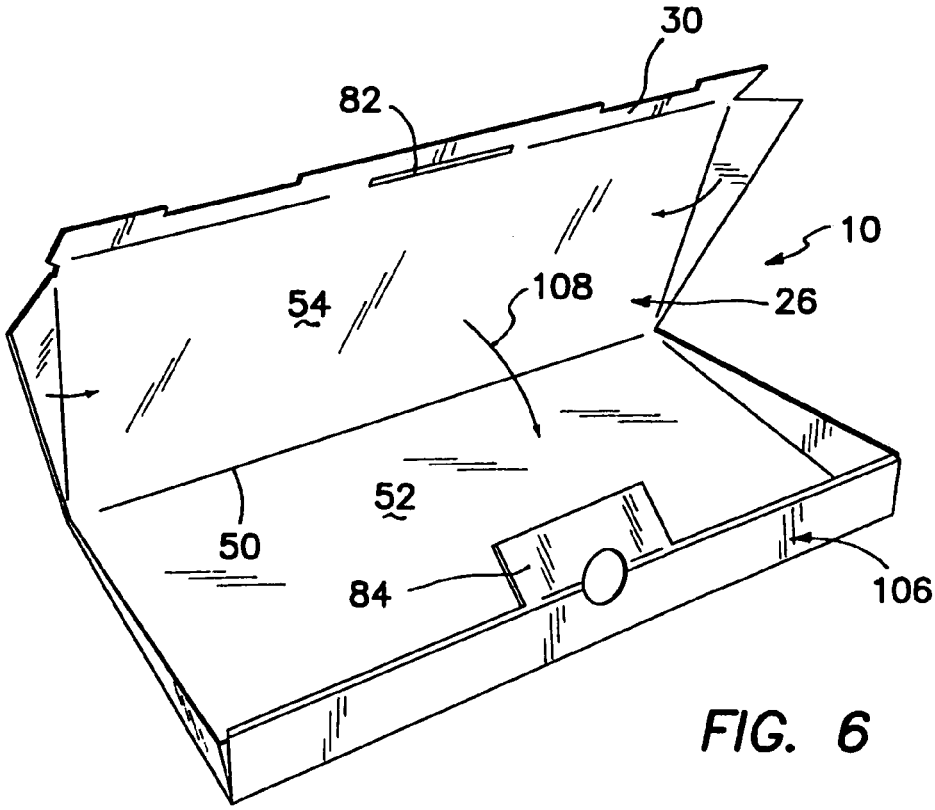
FIG. 6 shows perspective view of the first portion of the blank shown in FIG. 2 as the first portion is further folded into the space saving box shown in FIG. 1.

Assembly of the blank into space saving box 10 shown in FIG. 1 will be more clearly understood with reference to FIGS. 5 and 6.

As shown in FIG. 5, blank 20 (having the second portion 28 and side wall third segment 78 removed therefrom) is being folded along appropriate score lines such that sidewall first segment 74 and side wall second segment 76, and longitudinal support tabs 88 are folded inwardly in directions of arrows 92 and 94, respectively. Next, support portions 86 are separated from tab portion 84 and folded inwardly in direction of arrows 102.

An outer front wall 106, shown in FIG. 1 and FIG. 6, of space saving box 10, is formable by folding support portions 86 over and substantially enclosing support tabs 88. This step may be facilitated by provision of protrusions 86*a* and slots 86*b* sized to receive the protrusions 86*a*, shown in FIG. 4.

Specifically referring now to FIGS. 1 and 6, first portion 26 is now folded along transverse score line 50 (located behind crease 150 shown in FIG. 1) in the direction of arrow 108 (not shown in FIG. 1) to form tapered, space saving box 10, having segment 54 forming a top of the space saving box 10 and segment 52 (not shown in FIG. 1) forming a bottom of the space saving box 10. Common back panel 30 may be placed behind outer front wall 106 to close the box 10. Tab portion 84 may be inserted into slot 82 in order to secure the space saving box 10 in a closed configuration.

Notably, in accordance with this particular embodiment of the invention, the blank 20 is structured such that, when properly reconfigured, generally by manually folding along the various score lines provided thereon as described hereinabove, the resulting reduced sized box 10 has a sleek, space saving, easy to carry, gently tapering configuration.

It is to be appreciated that the scope of the present invention is considered to include the space saving box 10 itself, for example made from a blank having the configuration of first portion 26 shown in FIG. 4, without the provision of the second portion 28.

The advantages of the space saving box 10 of the present invention will be apparent to those of skill in the art and consumers alike.

The box 10 and blank 20 of the present invention minimizes waste of resources by facilitating reuse of nearly all of a full sized pizza box, for example, to form the serving segments 44 (see FIG. 3) and afterward, the space saving, "leftovers" box 10 (see FIG. 1). Breaking down the blank 20 as described herein also facilitates disposal thereof after use as a full sized box, for example into a standard kitchen trash can or recycle bin, when compared to the more cumbersome, conventional pizza boxes. It is to be appreciated that, with appropriate modifications thereto, the blank 20 can be structured such that the first portion and the second portion are both formable into two individual space saving boxes.

Preferably, in order to further minimize waste, the space saving boxes 10 and blanks 20 in accordance with the present invention are made of 100% recycled materials, for example, recycled paper products.

Advantageously, when placed in a refrigerator, the space saving box 10 is unlikely to be utilized as a storage surface for storage of other food items, such as, for example, heavy jars of food, due to the sloped nature of the top portion (e.g., segment 54) of the box 10.

In addition, two of said space saving boxes 10, in accordance with the present invention, can be stacked on top of one another in alternating fashion, to take up only as much space as the deepest dimension of a single one of the space saving boxes 10.

While this invention has been described with respect to various specific examples and embodiments, it is to be understood that the invention is not limited thereto and that it can be variously practiced within the scope of the following claims.

What is claimed is:

1. A box useful for pizza, the box comprising:

a first portion having a perimeter defined by opposing longitudinal side edges, a front edge and a back edge;

a second portion having a perimeter defined by opposing longitudinal side edges, a front edge and a back edge, the second portion being hingedly coupled to the first portion;

a pair of side walls each hingedly coupled to one of the opposing longitudinal side edges of the first portion, each of the side walls including a removable segment that is substantially triangular in at least one plane;

a front end wall hingedly coupled to the front edge of one of the first portion and the second portion;

a back end wall hingedly coupled to the back edge of one of the first portion and the second portion; and a transverse score line extending across the first portion, the transverse score line located between and spaced apart from the front edge of the first portion and the back edge of the first portion, and extending substantially between the opposing longitudinal side edges of the first portion;

the box being structured such that when the second portion is separated from the first portion and the separated first portion is creased along the transverse score line, the first portion, in an assembled condition, defines a container having an outer front wall, a hinge opposing the outer front wall and defined by the creased transverse score line, and a tapering depth that continually decreases from the outer front wall to the creased transverse score line.

2. The box of claim 1 being, in an unfolded state, a one piece blank.

3. The box of claim 1 wherein the transverse scoreline is offset from a centerline of the first portion.

4. The box of claim 1 wherein each of the side walls of the first portion includes at least one side wall score line to facilitate removal of the removable segment.

5. A box useful for pizza, the box comprising:

a first portion having a perimeter defined by opposing longitudinal side edges, a front edge and a back edge;

a second portion having a perimeter defined by opposing longitudinal side edges, a front edge and a back edge, the second portion bein hingedly coupled to the first portion;

a pair of side walls each hingedly coupled to one of the opposing longitudinal side edges of the first portion and each of the sidewalls including a substantially triangular segment having an edge coextensive along at least a portion of one of the opposing longitudinal side edges of the first portion;

a front end wall hingedly coupled to the front edge of one of the first portion and the second portion;

a back end wall hingedly coupled to the back edge of one of the first portion and the second portion; and a transverse score line extending across the first portion, the transverse score line located between and spaced apart from the front edge of the first portion and the back edge of the first portion, and extending substantially between the opposing longitudinal side edges of the first portion;

the box being structured such that when the second portion is separated from the first portion and the separated first portion is creased along the transverse score line, the first portion, in an assembled condition, defines a container having an outer front wall, a hinge opposing the outer front wall and defined by the creased transverse score line, and a tapering depth that continually decreases from the outer front wall to the creased transverse score line.

6. The box of claim 5 wherein the second portion includes second portion score lines to facilitate breaking the second portion into a plurality of segments.

7. The box of claim 6 wherein at least two of the second portion score lines cross each other.

8. The box of claim 6 wherein each of the plurality of segments is substantially equal in size.

9. The box of claim 1 which comprises recycled materials.

10. The box of claim 1 wherein the second portion includes second portion score lines to facilitate breaking the second portion into a plurality of segments.

11. The box of claim 10 wherein at least two of the second portion score lines cross each other.

12. The box of claim 10 wherein each of the plurality of segments is substantially equal in size.

13. The box of claim 5 which comprises recycled materials.

14. A product formable into a space saving box for pizza, the product comprising:

a substantially flat portion having a perimeter defined by opposing longitudinal side edges, a front edge and a back edge;

a pair of side walls each coupled to one of the opposing longitudinal side edges of the portion, each of the side walls including a removable segment which is substantially triangular in at least one plane;

a front end wall coupled to the front edge of the portion;

a back end wall coupled to the back edge of the portion; and a transverse score line located between and spaced apart from the front edge and the back edge of the portion and extending substantially between the opposing longitudinal side edges of the portion;

wherein, when the portion is folded along the transverse score line, the portion defines a box for pizza having an outer front wall and a tapering depth that continually decreases from the outer front wall to the folded transverse score line.

15. The product of claim 14 wherein the transverse score line is offset from a centerline of the portion.

16. The product of claim 14 wherein each of the side walls of the portion includes at least one side wall score line to facilitate removal of the removable segment.

17. The product of claim 14 wherein the substantially flat portion is a base of a box including a cover which is removed prior to the portion being folded along the transverse score line.

18. The product of claim 14 which comprises recycled materials.

* * * * *